United States Patent [19]

Nes et al.

[11] 4,265,676

[45] May 5, 1981

[54] PROCESS FOR MANUFACTURE OF STRIP-CASTED AL-SHEET MATERIAL WITH IMPROVED MECHANICAL AND THERMOMECHANICAL QUALITIES

[75] Inventors: Aasmund E. Nes, Rykkinn; Sverre Slevolden, Kopervik, both of Norway

[73] Assignee: Norsk Hydro a.s., Oslo, Norway

[21] Appl. No.: 45,267

[22] Filed: Jun. 4, 1979

[30] Foreign Application Priority Data

Jun. 27, 1978 [NO] Norway ..... 782215

[51] Int. Cl.[3] ..... C22F 1/04

[52] U.S. Cl. ..... 148/2; 148/11.5 A

[58] Field of Search ..... 148/2, 11.5 A

[56] References Cited

U.S. PATENT DOCUMENTS 4,033,794 7/1977 Stowell et al. ..... 148/11.5 A

FOREIGN PATENT DOCUMENTS 1192281 5/1970 United Kingdom .

*Primary Examiner*—R. Dean

*Attorney, Agent, or Firm*—Wenderoth, Lind & Ponack

[57] ABSTRACT

A process for the manufacture of half-hard aluminium sheet materials with high strength in combination with high ductility is based upon commercially available Al-wrought alloys having added thereto at least one recrystallization modifying element such as Zr, Nb, Ta, Hf, Ni, Cr, Ti, V or W. Wrought alloys containing less than 0.5 wt. % of the modifying elements, which are substantially present in solid solution, are cast by continuous strip-casting as a plate which is directly cooled to ambient temperature and cold rolled to a requested thickness, followed by a final heat treatment where the temperature is brought up to 400–500° C. at heating rates lower than 50° C./min. with following cooling down to ambient temperature.

10 Claims, 4 Drawing Figures

PROCESS FOR MANUFACTURE OF STRIP-CASTED AL-SHEET MATERIAL WITH IMPROVED MECHANICAL AND THERMOMECHANICAL QUALITIES

This invention relates to a process for manufacture of half-hard aluminium sheet material with improved mechanical properties based upon commercial available, cold workable Al-wrought alloys.

In the conventional metal forming into sheet material the rolling ingots are formed by semicontinuous casting. These rolling ingots are subjected to a homogenization treatment from 12 to 24 hours at elevated temperature, e.g. from 490° to 500° C., close to the solidus temperature of the metal. After that follows hot rolling at somewhat lower temperature, 400°-450° C., followed by cold rolling and final annealing, that is a heat treatment at approx. 380° C. for about 2 hours. As an alternative to cold rolling and final annealing there is also applied an intermediate annealing after hot rolling at 420° C., followed by final cold rolling.

A more modern technology for manufacture of rolled sheet material is so called strip-casting. This is a continuous sheet casting technique characterized by a high rate of solidification during quenching of the cast material which allows higher casting speeds. It is necessary also in this case to proceed with further working of the cast sheet material in order to obtain a product with satisfactory mechanical properties. This working includes cold rolling of the casted material down to a suitable dimension, annealing at approximately 420° C., for 4 hours, followed by so called temperpass, that is a further cold rolling also called temper-rolling. During this temper-rolling the material thickness is reduced by 15% or more.

It is known that addition of certain elements like Zr, Nb, Ta and Ni in a total amount from 0.3 to 0.8% to certain non-heat-treatable wrought aluminium alloys will result in an increase of the recrystallization temperature. According to U.S. Pat. No. 2,245,166, issued on June 10, 1941, an addition of zirconium in amount from 0.01 to 1.0% to copper-free wrought aluminum-magnesium alloy containing from 0.25 to 10.0% Mg is recommended in order to increase the recrystallization temperature. It has also been suggested to make use of zirconium additions in several commercial high strength and medium strength alloys in the 7000-series AlZnMg(Cu). Such additions result in a certain increase of the recrystallization temperature which gives better possibilities to manufacture hot formed products without substantial recrystallization in the final product. No substantial improvement in the mechanical qualities, yield strength tensile strength and ductility is achieved by conventional heat treatment and hot rolling of the cast rolling slabs.

Figure 1A:
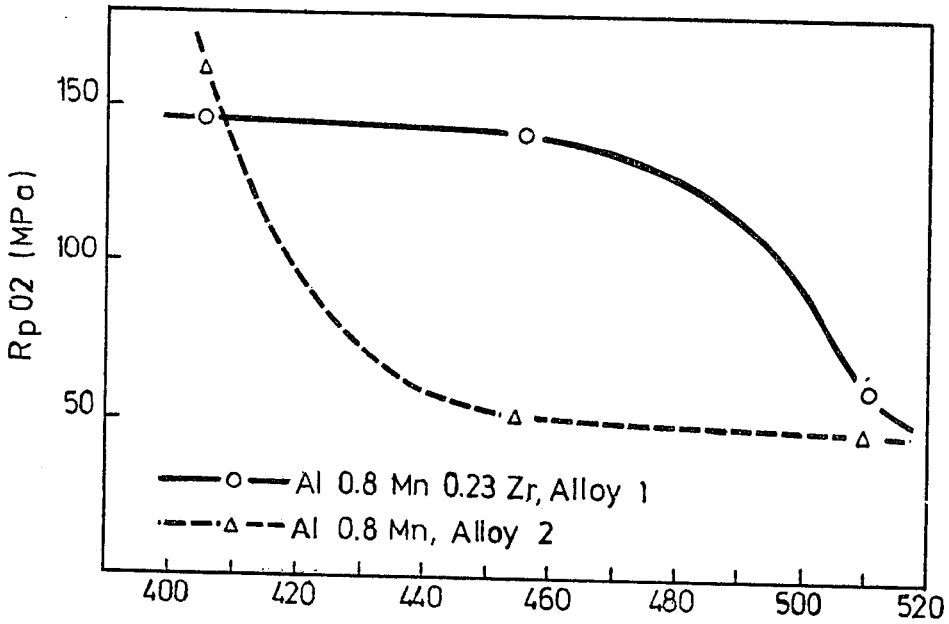
FIG. 1*a* is a graph showing yield strength of materials according to Example 1.

This invention relates to cold workable wrought alloys comprising following aluminium alloys:

1. AlMn-wrought alloy containing from 0.30 to 1.35 wt.% Mn.
2. AlMgMn-wrought alloy containing from 0.2 to 0.8 wt.% Mg and from 0.3 to 0.8 wt.% Mn.
3. AlMgSi-wrought alloy containing from 0.45 to 0.90 wt.% Mg and from 0.2 to 0.6 wt.% Si.
4. AlMg-wrought alloy containing from 0.5 to 1.1 wt.% Mg.
5. Technical pure aluminium with minimum 99.0 wt.% Al and the rest consists mainly of Si and Fe.

According to the present invention, by means of stripcasting technology, directly followed by cold rolling and a special heat treatment, there have been manufactured sheets of Al-wrought alloys with substantially improved properties, that is a substantial increase of ductility with retained tensile strength and a substantial increase of the recrystallization temperature, and at the same time achievement of a high tensile strength and ductility at elevated temperatures.

The surprising feature of the manufacture of Al-sheet material according to the invention is that even the addition of only small amounts of recrystallization-modifying elements as e.g. Zr, Nb, Ta, Hf, Ni, Cr, Ti, V or W, will result in considerable improvement of thermo-mechanical properties. The improvement is a result of the applied strip-casting technology, where the modifying elements because of high solidification rate are substantially present in solid solution, and the application of a special final heat treatment after cold rolling down to the requested final thickness.

At the same time the manufacturing process is substantially simplified as compared with the conventional hot and cold rolling processes. The addition of structure-modifying elements in these wrought alloys is so small that the casting rate is not influenced, e.g. by use of zirconium in amounts up to 0.3 wt.%.

This substantial technical progress is achieved by means of the special process which is distinctly pointed out in patent claims.

Stated below is a description of the process carried out in practice. An aluminium alloy consisting of 0.15% Si, 0.5% Fe, 0.75% Mn, 0.22% Zr and the rest mainly Al is cast by strip-casting, that is by casting between inside cooled, rotating rolls. After coiling and cooling down to the ambient temperature the sheet is rolled down from the initial thickness of about 7.0 mm to the requested final thickness, for example 1.0 mm by a cold rolling process. The cold deformation results in a heavy increase of the hardness and at the same time reduced ductility. This combination of properties is not desirable for a range of applications. It will therefore be necessary, in the case of a conventional alloy composition, after rolling operation to proceed with a soft annealing operation followed by a temper-rolling in order to achieve the requested properties. On the contrary, during the process according to the invention the cold rolled sheet simply undergoes a final heat treatment where the metal temperature is brought slowly up to 420°-470° C., kept there for about 2 hours before the following cooling down to the ambient temperature.

Opposed to commercial Al-alloys, which will be soft annealed after a such final heat treatment without temper-pass, the mechanical properties of the zirconium containing alloy will stabilize at the level corresponding to a deformation hardened, half-hard quality of a corresponding Zr-free alloy, except for the difference in the ductility which is substantially improved. In order to achieve this stabilization of deformation structure in the Zr-containing alloy variant it is required that the heating rate during heat treatment after cold rolling does not exceed a certain critical rate. The critical rates are about 50° C./min., and an optimal heating rate for the heat treatment according to the present invention is in the range from 1° to 4° c./min.

This low heating rate is necessary in order to get nucleation of the finely dispersed $Al_3Zr$ particles which are required for stabilization of the substructure. The casting temperature during strip-casting is in the range 680°–750° C. depending on the wrought alloy used and the actual modifying addition element. In the case of AlMn-alloy and zirconium addition it is appropriate to cast at 680°–700° C.

The fundamental difference between an alloy with zirconium addition and one without zirconium will be demonstrated by the following example.

EXAMPLE 1

Two strip-casted AlMn-alloys (thickness of the cast material about 7 mm) which are identical except for the zirconium addition—alloy 1 (Al 0.8 Mn 0.23 Zr) and alloy 2 (Al 0.8 Mn) are used in the following test. After casting from 690° C. were both materials were cold rolled to 1 mm thick sheets. Samples taken from these plates were heated to different temperatures in the temperature range from 400° to 520° C. All heat treatments are conducted at the same heating rate 50° C./hour to the holding temperature. The holding time was for all tests 2 hours, followed by cooling of the sample in the air.

TABLE 1

Mechanical properties measured at ambient temperature after heat treatment at different temperatures.

| Temp. °C. | $R_{PO,2}$ MPa Al0,8Mn | $R_{PO,2}$ MPa Al0,8MnO, 29Zr | $A_B$ % Al0,8Mn | $A_B$ % Al0,8MnO, 23Zr |
|---|---|---|---|---|
| 405 | 160 | 143 | 8 | 11 |
| 454 | 55 | 143 | 34 | 16 |
| 510 | 53 | 62 | 37 | 27 |

Figure 1B:
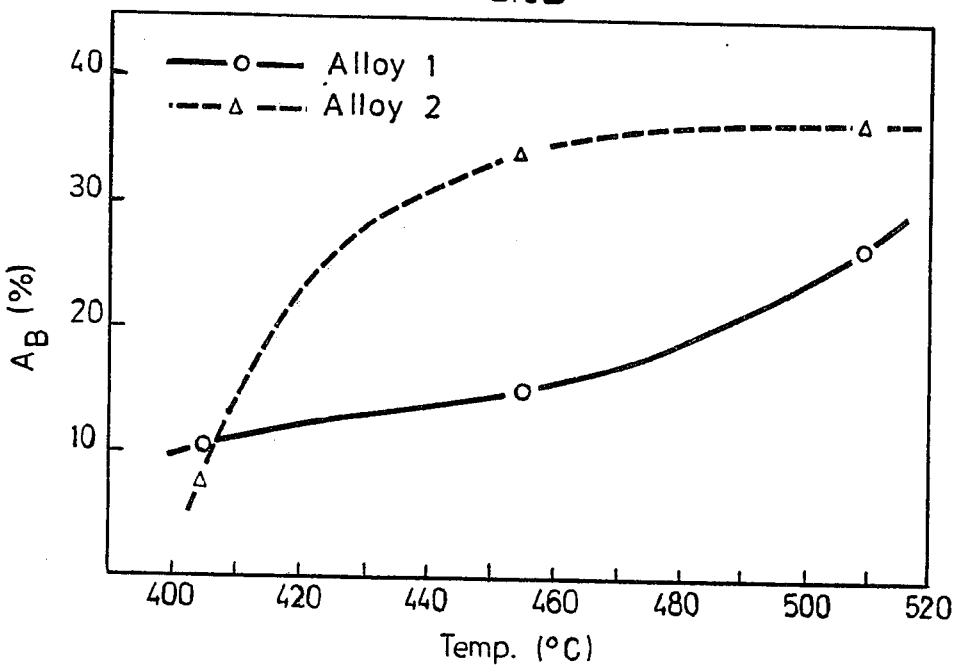
FIG. 1*b* is a graph showing ductility of materials according to Example 1.

The results in Table 1 and FIG. 1 show how the strength, defined by yield strength Rp 0.2 (FIG. 1*a*), and ductility defined by the elongation $A_B$ (FIG. 1*b*), where the measured length is equal to four times the width of the sample, change with the temperature of the heat treatment. These results show that while alloy 2 displays a quick fall in strength with increasing temperature in the range 400°–420° C., alloy 1 shows remarkable strength stability. It is first at the heat treatment temperature over approximately 480° C. that a faster fall in strength starts with increasing temperature. It means that an addition of about 0.2% has allowed an increase in the recrystallization temperature (defined as 50% reduction of strength after 2 hours at holding temperature) by as much as 80° C. from 410° C. to 490° C.

For further demonstration of the advantages achieved by the process according to the invention there is described below a test which shows that by the means of this process it is possible to manufacture alloy qualities with substantially improved resistance against thermal recovery as compared to conventional manufactured sheet material of the same alloys without zirconium addition.

EXAMPLE 2

The conventionally produced sheet material without zirconium addition (alloy 2) was strip-cast and afterwards rolled down in four passes to 1.25 mm, soft annealed at 420° C. for 4 hours (usual batch) with following temper-rolling from 1.25 mm to 0.88 mm which represents a 30% reduction in material thickness.

The sheet material manufactured according to the invention (alloy 1) was cast from 690° C. and directly rolled down from 7.0 mm to 1.0 mm (approx. reduction 85%), followed by a batch annealing for 2 hours at 440° C. The exact composition of alloys is stated in Table 2.

TABLE 2

| Zr | Si | Fe | Mg | Mn | Cu | Ti | B | V |
|---|---|---|---|---|---|---|---|---|
| Composition of alloys | | | | | | | | |
| Alloy 1: | | | | | | | | |
| 0.23 | 0.15 | 0.47 | 0.03 | 0.8 | 0.002 | 0.017 | 0.003 | 0.012 |
| Alloy 2: | | | | | | | | |
| — | 0.12 | 0.41 | 0.008 | 0.8 | 0.002 | 0.017 | 0.004 | 0.004 |

The two sheet qualities were tested in a standard tensile testing machine in order to measure the mechanical properties:

(1) at elevated temperature and (2) after a long time heat treatment at elevated (high) temperature.

Figure 2:
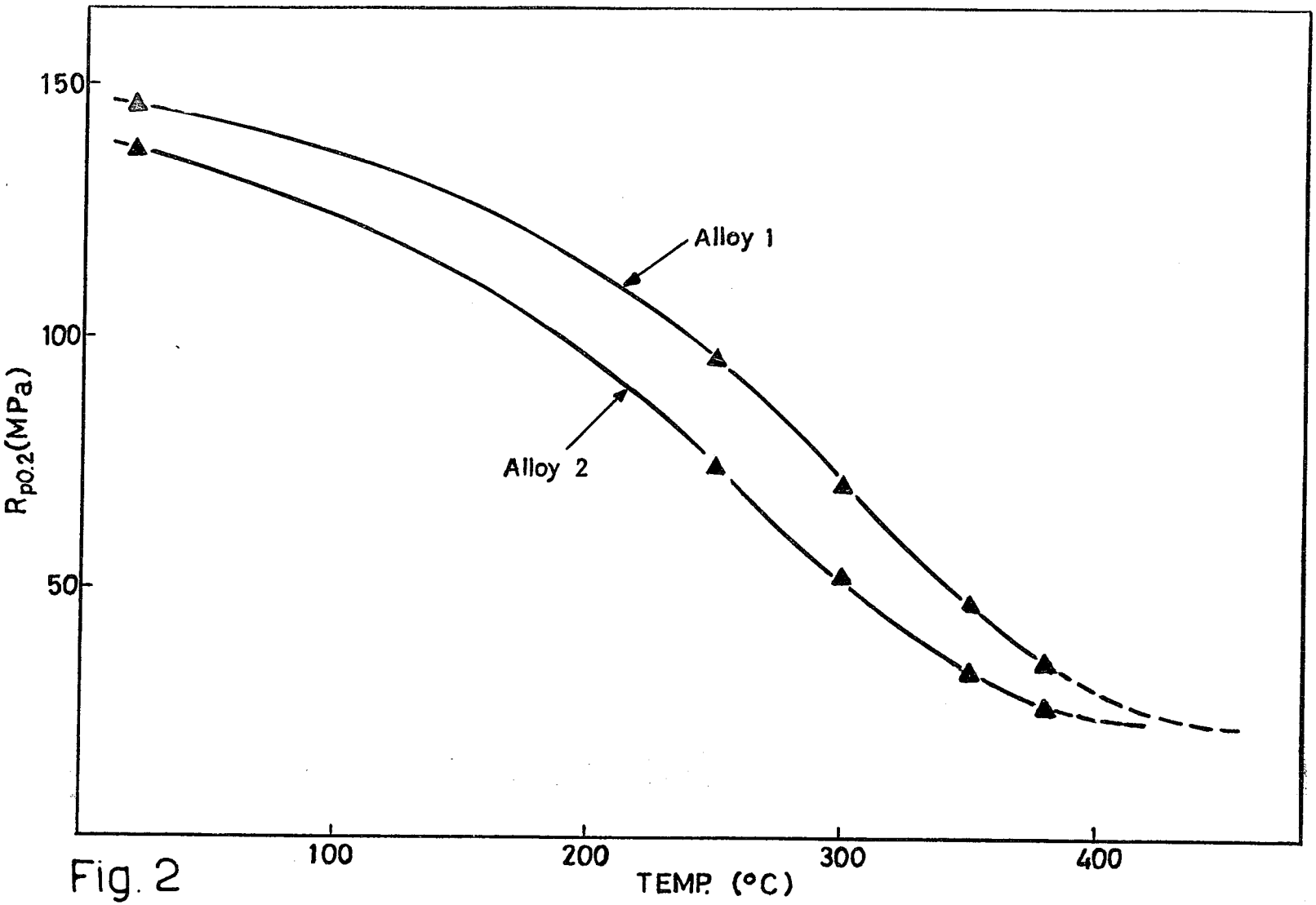
FIG. 2 is a graph showing strength of materials according to Example 2.
Figure 3:
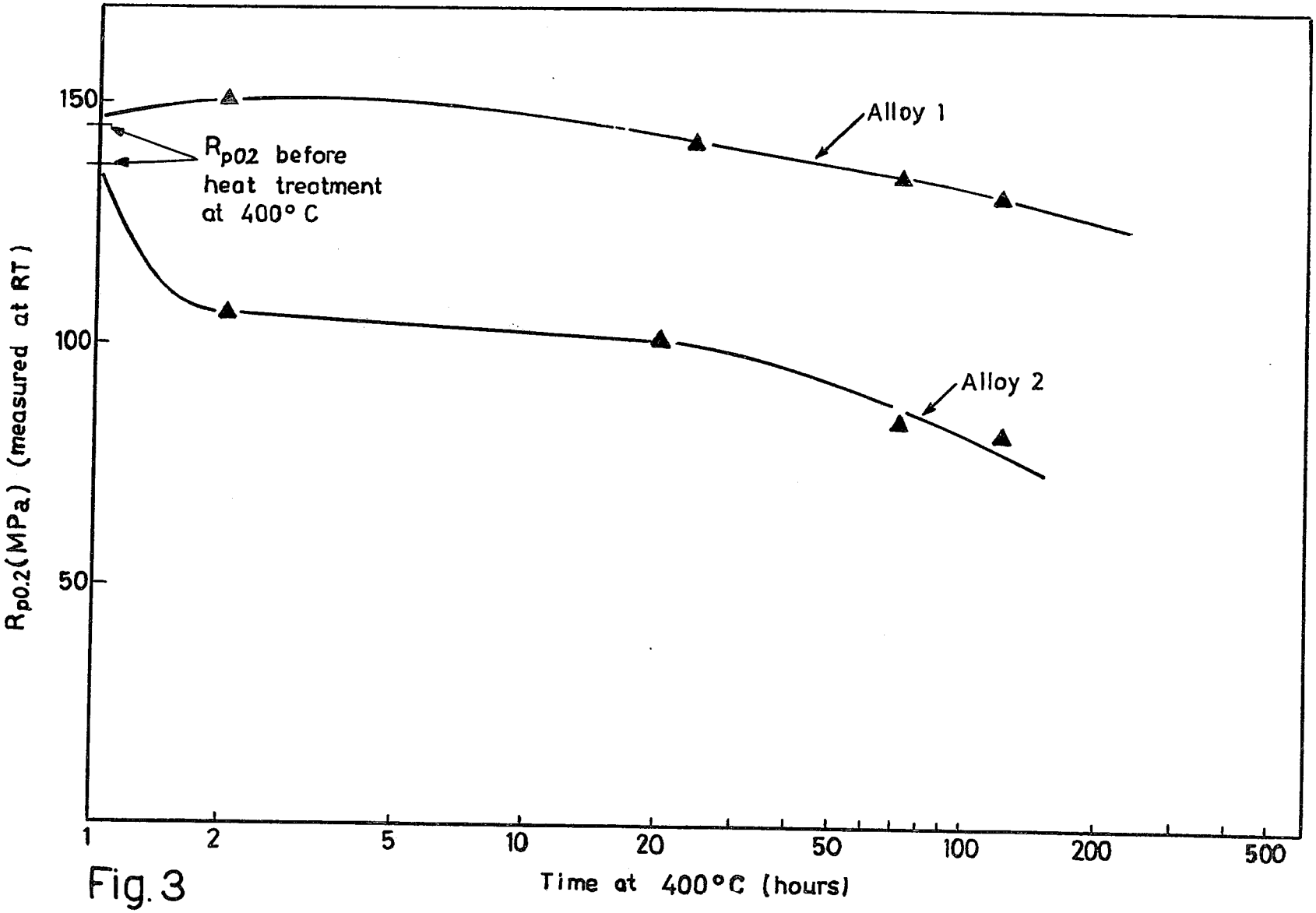
FIG. 3 is a graph showing strength of materials according to Example 2.

The results are listed in Table 3 and 4 and also displayed graphically in FIG. 2 and 3.

TABLE 3

Strength and ductility at ambient and elevated temperatures

| Temp. °C. | $R_{PO,2}$ MPa Alloy 1 | $R_{PO,2}$ MPa Alloy 2 | $R_m$ MPa Alloy 1 | $R_m$ MPa Alloy 2 | $A_B$ % Alloy 1 | $A_B$ % Alloy 2 |
|---|---|---|---|---|---|---|
| RT | 143 | 134 | 165 | 146 | 14.2 | 7.2 |
| 250 | 94 | 73 | 104 | 78 | 15.0 | 11.8 |
| 300 | 69 | 51 | 77 | 58 | 28.5 | 20.0 |
| 350 | 45 | 32 | 54 | 39 | 31.0 | 30.0 |
| 380 | 34 | 25 | 43 | 33 | 47.3 | 34.2 |

TABLE 4

Mechanical properties after heat treatment at different holding times at 400° C.
(The properties are measured at ambient temperature)

| Time at 400° C. hours | $R_{PO,2}$ MPa Alloy 1 | $R_{PO,2}$ MPa Alloy 2 | $R_m$ MPa Alloy 1 | $R_m$ MPa Alloy 2 | $A_B$ % Alloy 1 | $A_B$ % Alloy 2 |
|---|---|---|---|---|---|---|
| 2 | 148 | 107 | 165 | 126 | 13.2 | 13.1 |
| 20 | 139 | 104 | 159 | 118 | 16.2 | 16.0 |
| 72 | 134 | 82 | 158 | 106 | 13.9 | 22.6 |
| 120 | 130 | 81 | 153 | 104 | 17.2 | 25.0 |

It is apparent from the results that while both alloys 1 and 2 at room temperature are comparable in strength, alloy 1 is substantially more ductile and exhibits a much better strength at elevated temperatures (Table 3).

Furthermore, the zirconium alloy can be held for longer periods at relatively high temperatures without reduction in the properties at the ambient temperature. For example alloy 1 shows only a little strength reduction after 120 hours at 400° C. while the strength of alloy 2 is reduced by approximately 30% already after 2 hours at the same temperature (FIG. 3).

From the other conducted tests it is evident that the alloy according to the invention has a superior forming properties and high ductility at elevated temperatures when applying low forming rates.

We claim:

1. A process for the manufacture of half-hard aluminun sheet materials having a combination of high strength and high ductility which comprises casting by continuous strip-casting as a plate a commercially available Al-wrought alloy containing less than 0.5 weight % of at least one recrystallization modifying element selected from the group consisting of Zr, Nb, Ta, Hf, Ni, Cr, Ti, V and W, said modifying element being present substantially in solid solution, directly cooling the thus casted material to ambient temperature and cold rolling said material to a required thickness, heating the thus rolled material to a holding temperature of from 400°to 500° C. at a heating rate of less than 50° C./min, and cooling the material to ambient temperature.

2. A process according to claim 1 wherein the heating rate during the heat treatment is from 1° to 4° C./min.

3. A process according to claim 1 wherein the holding temperature during the heat treatment is 440°-460° C.

4. A process according to claim 1 wherein the modifying element is zirconium in an amount of from 0.1 to 0.3 wt. %.

5. A process according to claim 1, wherein the alloy material thickness is reduced at least by 65% of the original thickness by the cold rolling.

6. A process according to claim 1 wherein the wrought alloy consists of AlMn-wrought alloy containing from 0.30 to 1.35 wt. % Mn.

7. A process according to claim 1 wherein the wrought alloy consists of AlMgMn-wrought alloy containing from 0.2 to 0.8 wt. % Mg and from 0.3 to 0.8 wt. % Mn.

8. A process according to claim 1 wherein the wrought alloy consists of AlMgSi-wrought alloy containing from 0.45 to 0.90 wt.% Mg and from 0.2 to 0.6 wt.% Si.

9. A process according to claim 1 wherein the wrought alloy consists of AlMg-wrought alloy containing from 0.5 to 1.1 wt.% Mg.

10. A process according to claim 1 wherein the Al-wrought alloy is technical pure aluminum containing 99.0 wt.% Al and the rest consists mainly of Si and Fe.

* * * * *